US006335709B1

(12) United States Patent
Cummings

(10) Patent No.: US 6,335,709 B1
(45) Date of Patent: Jan. 1, 2002

(54) INTEGRATED SERVICE TOWER

(75) Inventor: Carl S. Cummings, Warthen, GA (US)

(73) Assignee: Utility Service Company, Perry, GA (US)

( * ) Notice: Subject to any disclaimer, the term of this patent is extended or adjusted under 35 U.S.C. 154(b) by 0 days.

(21) Appl. No.: 09/605,024

(22) Filed: Jun. 28, 2000

(51) Int. Cl.[7] ..... H01Q 1/12
(52) U.S. Cl. ..... 343/890; 52/40; 343/874
(58) Field of Search ..... 343/874, 878, 343/890, 891; 169/52; 52/40; H01Q 1/12

(56) References Cited

U.S. PATENT DOCUMENTS 4,517,775 A * 5/1985 Engel ..... 52/40
5,611,176 A * 3/1997 Juengert et al. ..... 52/40
5,649,402 A * 7/1997 Moore ..... 52/651.02
5,855,103 A * 1/1999 Moore ..... 52/651.02
5,904,004 A * 5/1999 Hill ..... 52/40
5,963,178 A * 10/1999 Jones ..... 343/890
6,026,627 A * 2/2000 Moore ..... 52/621.02
6,131,349 A * 10/2000 Hill ..... 52/292
6,173,537 B1 * 1/2001 Davidsson et al. ..... 52/40

* cited by examiner

*Primary Examiner*—Don Wong
*Assistant Examiner*—Trinh Vo Dinh
(74) *Attorney, Agent, or Firm*—John L. James

(57) ABSTRACT

A service tower integrates a water tank and an antenna mast into a single structure. The integrated tower structure has a bottom tank for holding water, a top member for mounting the antenna, and a middle transitional section that connects the larger diameter tanker to the smaller mast. A cable is port formed in the bottom end of the mast to receive communications cables from the exterior sidewall of the tank and deliver them to the interior sidewall of the mast. An antenna support is fastened to the mast above the cable port. A hollow support arm is fastened to the mast about an opening forming a passageway from the interior of the mast to the interior of the support arm. Cables are routed through the passageway to the antenna from inside the mast.

9 Claims, 4 Drawing Sheets

INTEGRATED SERVICE TOWER

FIELD OF THE INVENTION

The present invention relates generally to a utility service tower, and, more particularly, to a water tower with a cell telephone antenna.

BACKGROUND OF THE INVENTION

With the proliferation of cell phones and personal communications devices comes the need for antenna towers to support antennas for wireless transmission. These devices generally operate on a line-of-sight basis with an antenna; so, an antenna must be raised above the height of obstructions such as trees, buildings and landscape. A typical minimum height for an antenna is about a hundred feet. An antenna can sometimes be mounted on an electrical or telephone utility pole or tower provided the height is sufficient. While utility poles are virtually everywhere, they very often lack the required height, and the close proximity of antennas and power lines causes interference which deteriorates the quality of wireless transmissions. Antennas can be mounted on existing structures such as the top of a water tower. Cabling required for the antenna is routed up the side of the tower and across the top to the antennas. While this works well for the antenna, it creates problems when performing water tower maintenance such as painting. Accordingly, it will be appreciated that it would be highly desirable to mount a wireless antenna on a structure at the required height without creating electrical interference or maintenance problems.

Because of the low power output of individual cell phones and other wireless devices, satellites cannot be used and do not replace the need for towers. Wireless antennas are costly and have a limited range but wireless devices are very popular, and are gaining in popularity daily. Tower cost is a fact that accounts for rapid wireless growth in large cities, heavily populated suburbs and along major arteries and limited excursion into smaller towns, communities and rural areas. Increasingly, moratoriums are being imposed on building additional antenna towers because, while they are needed for wireless device operation which everybody seems to want, nobody really wants them where they live or play.

Fortunately, with the growth of countywide fire departments, there come additional water towers which can be used for mounting antennas. However, mounting antennas on these towers make water tower maintenance more difficult because the of the cables that are typically routed up the tower and criss-cross the top of the tank. Also, the tower roof sometimes has to be reinforced to support the weight of the antenna. Accordingly, it will be appreciated that it would be highly desirable to have a water tower that can mount an antenna without creating maintenance problems and that is reasonably unobtrusive.

SUMMARY OF THE INVENTION

The present invention is directed to overcoming one or more of the problems set forth above. Briefly summarized, according to one aspect of the present invention, a service tower combines a water tower and antenna mast into a single structure. The tower has a bottom member for holding water, a top member for mounting the antenna, and a middle transitional section that connects the larger bottom member to the smaller top member. The top and bottom members are cylindrical and the transitional member is frustoconical.

Ideally, the transition member has a height, top diameter and bottom diameter with the height being equal to the difference between the top and bottom diameters; and, the height of the bottom member is at least twice the height of the top member. A cable port is formed in the bottom end portion of the top member to receive communications cables to run inside the top member to the antennas. An antenna support is fastened to the top member above the cable port. A hollow support arm is fastened to the top member about an opening forming a passageway from the interior of the top member to the interior of the support arm. Cables are routed through the passageway to the antenna.

The cable port is the entrance for cables to the interior of the antenna mast portion of the service tower which eliminates the need for cables to crisscross the top of the structure. The service tower is designed as a unit that mounts on the ground and does not need additional reinforcing to support the antennas. The service tower has a smaller footprint than traditional water towers that are elevated on support legs and are therefore less obtrusive than standard water towers.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
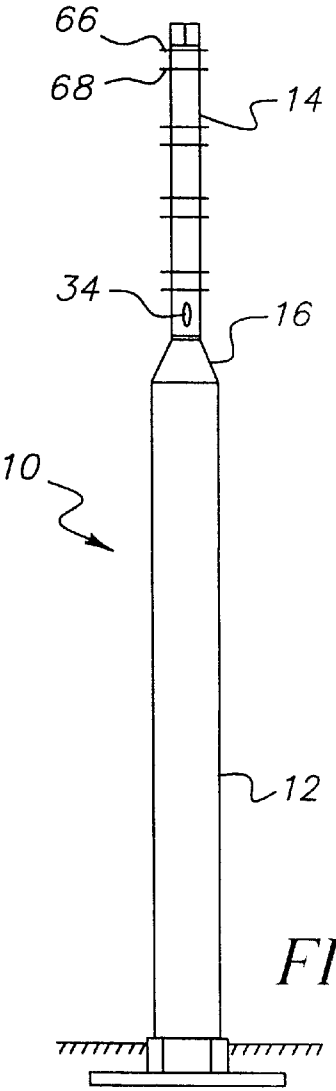
FIG. 1 is a diagrammatic front elevational view of a preferred embodiment of a three section, combined water and antenna tower.

Referring to FIG. 1, a service tower 10 for combined use as a water tower and antenna tower has a bottom tank 12 for storing water and top mast 14 for mounting antenna equipment. The invention will be described with reference to a nominal 100-foot high tank with a 10-foot diameter, and a 50-foot mast with a four foot diameter, each constructed of ¼-inch thick steel. Such a service tower stores approximately 60,000 gallons of water, provides 45 pounds of gravity supplied water pressure at the base when full, and can withstand hurricane force winds. It is to be understood that the diameters and steel thickness can be increased to accommodate stronger winds or to store more water, but the 4-foot diameter of the cell phone mast is a practical minimum diameter to accommodate 24 communications cables and a technician with equipment inside the antenna mast.

Bottom tank 12 is preferably mounted at, or slightly above, ground level on an anchored concrete pad. Mounting lugs welded or bolted to bottom tank 12 can receive bolts anchored in the concrete pad, or other mounting means can be used that fasten the tank to the pad.

Figure 2:
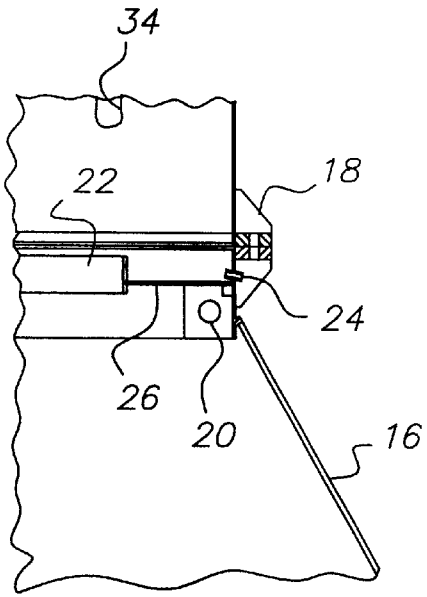
FIG. 2 is a somewhat enlarged view of the connection between two of the three sections of the tower of FIG. 1.

Referring to FIGS. 1 and 2, a transition member 16 is positioned between bottom tank 12 and top mast 14 to make the transition between the 10-foot and 4-foot diameter sections. For a cylindrical tank 12 and mast 14, transition member 16 is frustoconical. It transitions from a 10-foot diameter to a 4-foot diameter in a 6-foot distance. Transition member 16 is preferably bolted to mast 14 a multiple points about the periphery using mounting lugs 18. Each lug 18 can consist of a horizontal plate fitted between two vertical plates and welded thereto. Both the horizontal and vertical plates are welded to the mast 12 or welded to the transition member 16. A pair of lugs 18, one on mast 14 and one on transition member 16, are bolted together to make the joint. Alternatively, mast 14 and member 16 have mating circumferential flanges that are bolted together to make the joint. Likewise, mounting lugs or flanges can be used to attach transition member 16 to tank 12, or they may be welded together. As a practical matter, tank 12 is fabricated from thirteen rings each about 8-feet high. One, or several rings welded together depending on highway restrictions, are trucked to the site and welded into the tank 12. Normally, the smaller antenna mast 14 is fully assembled and galvanized before shipping to the site.

Transition member 16 has rigging lugs 20 for lifting it and water tank 12. An access door 22 in the top of transition member 16 allows passage between member 16 and mast 14. A weep hole 24 just above ceiling 26 of member 16 allows moisture to drain from mast 16.

Figure 4:
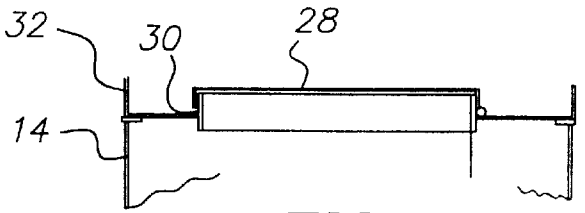
FIG. 4 is a diagrammatic sectional view taken along line 4—4 of FIG. 3.
Figure 3:
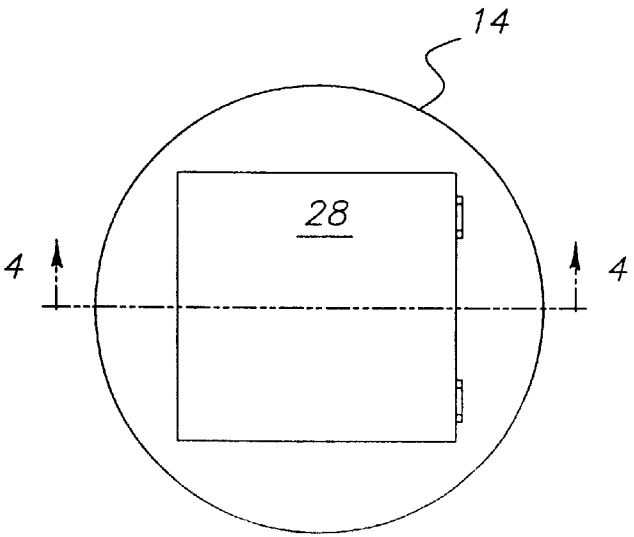
FIG. 3 is diagrammatic top view of the top of the tower illustrating a roof hatch.

Referring now to FIGS. 3 and 4, a hinged roof hatch 28, similar to door 22 but larger, is located over an opening in the top of the mast. Roof hatch 28 is a raised door that rests on a flange 30 which prevents rain or melting snow from entering the mast. For a 4-foot diameter mast, the hatch can be a 30-inch square.

A safety rail and toe board 32 is fastened to the top of the mast along the perimeter to help provide safe entry and egress through the roof hatch 28. The toe board provides an area where small tools and equipment can be placed without sliding off the roof of the mast.

Referring to FIGS. 1, and 8–11, mast 14 has a cable port 34 that fits in an opening in the mast sidewall for routing cables 36. Alternatively, transition member 14 has a cable port 34' that is an opening in its sidewall for routing cables. Cable port 34 has a nozzle neck 38 that provides reinforcement for the removed mast wall area. As illustrated, cable port 34 will support three cables horizontally and eight cables vertically with the cables divided into two cable groups 40, 42. The largest cables for this use can each have a 2¼-inch diameter with a minimum bending radius of 24 inches. Cables are routed up the outside sidewall of tank 12 using cable racks or other devices to keep them bundled in two circular patterns. Before entering cable port 34, the cables must make a 90° turn from vertical to horizontal without violating the minimum bending radius. Once inside, the cables 36 turn up the mast to arrive at patterns along the sidewall where cables 40 are on one side of inside ladder 44 and cables 42 are on the other side of ladder 44. Also, the cables must not block passageways to the support arms 46, 48, 50 that are spaced at 120° intervals about the periphery of the mast.

Figure 7:
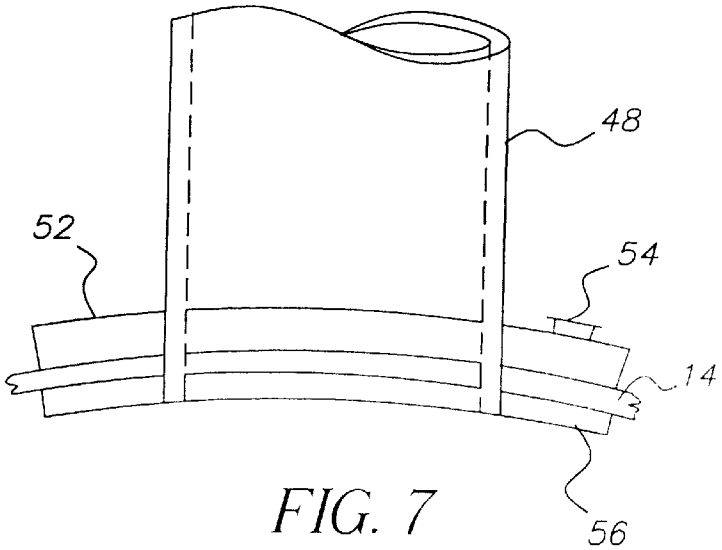
FIG. 7 is a diagrammatic sectional view illustrating the connection between the support arm and tower.
Figure 6:
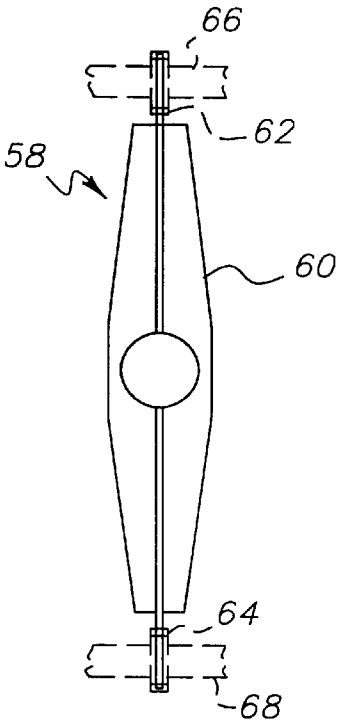
FIG. 6 is a diagrammatic front view of the antenna support of FIG. 5.
Figure 5:
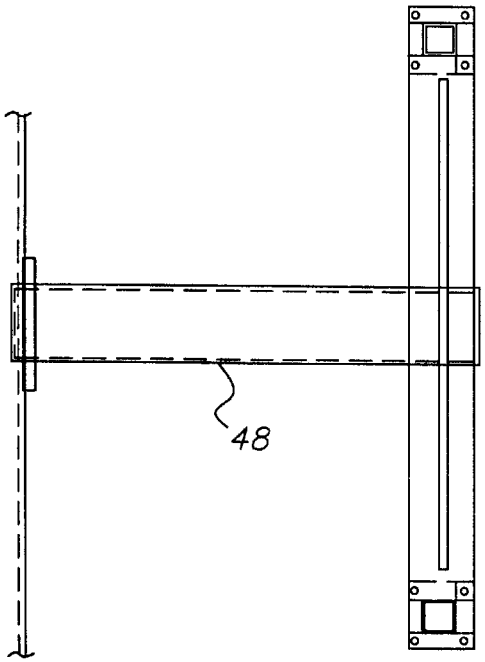
FIG. 5 is a diagrammatic side view showing a support arm connected to the tower with an antenna support attached to the arm.
Figure 9:
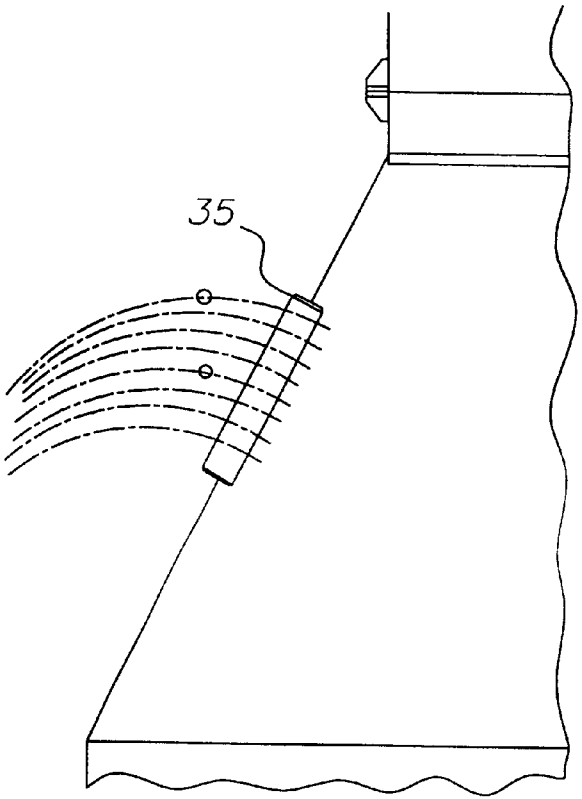
FIG. 9 illustrates another embodiment similar to FIG. 8 where the communications cables are routed through a cable port in the middle section of the tower.
Figure 8:
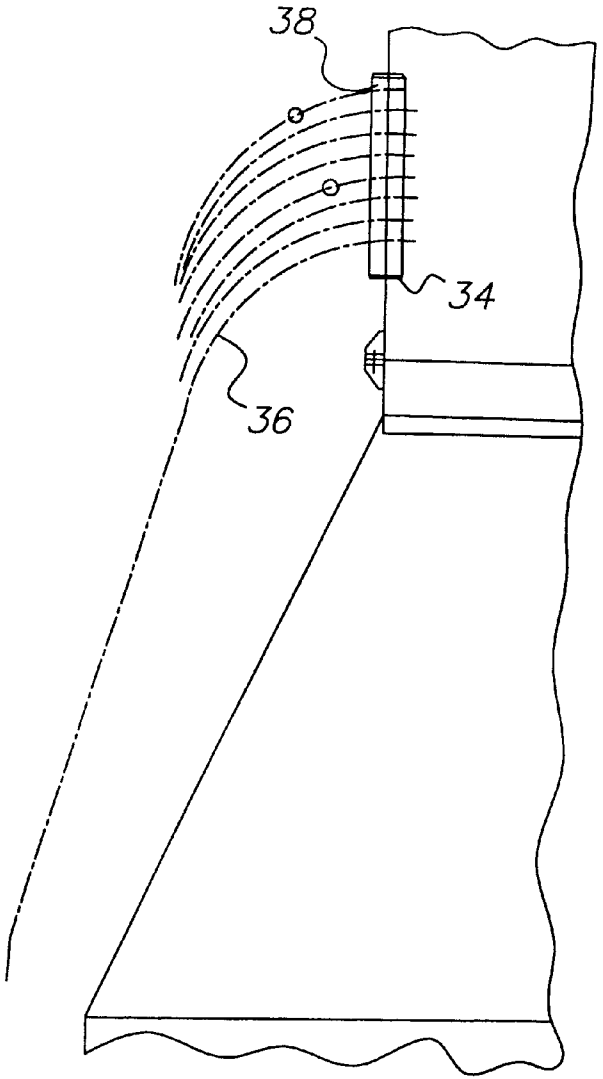
FIG. 8 is a diagrammatic view illustrating the routing of communications cables through a cable port in the top section of the tower.
Figure 10:
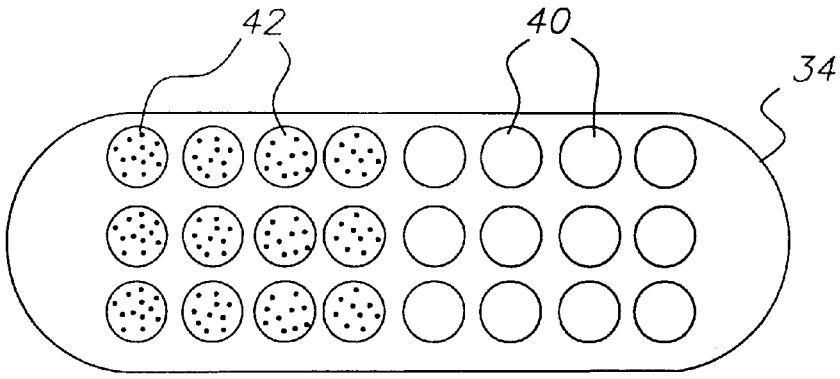
FIG. 10 illustrates a front view of the cable port of FIGS. 8 and 9.
Figure 11:
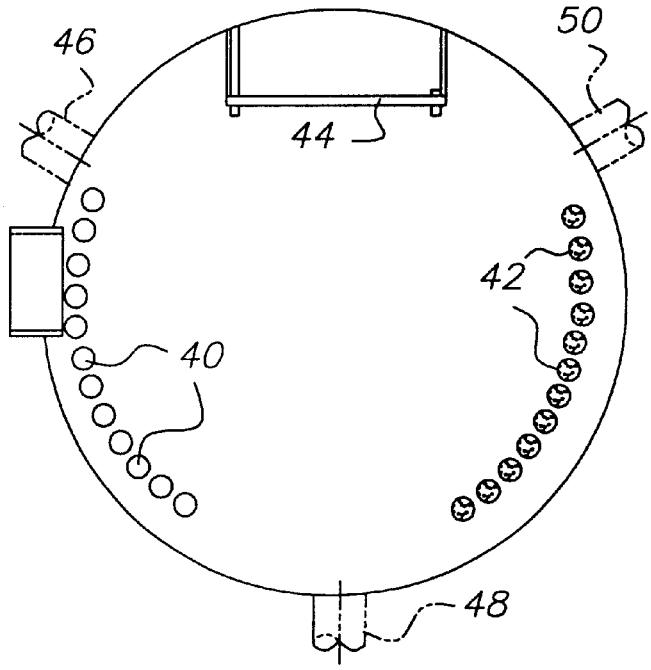
FIG. 11 is a diagrammatic sectional view of the top portion of the tower illustrating the layout of the communications cables.

Referring to FIGS. 5–7, a hollow radial support arm 48 mounts on the mast about an opening in the mast sidewall. Near one end of radial support arm 48 is welded a mounting plate 52 with an opening through which arm 48 protrudes. Mounting plate 52 has four openings for receiving bolts 54. A reinforcing plate 56 is welded to the inside of the mast and has a central opening concentric with the mast opening for receiving the protruding end of support arm 48. Preferably, the protruding end of support arm 48 is flush with the interior surface of reinforcing plate 56. When assembled, there is a passageway from the interior of the mast into the hollow interior of radial support arm 48. This passageway enables jumper cables from the main cable 36 to be routed out the arms to the antennas.

A vertical plate assembly 58 is attached to the distal end of radial support arm 48. Plate 60 has a central opening into which support arm 48 extends where it is welded while preserving the passageway for the jumper cables. Extending from plate 68 are top and bottom connecting members, such as rods 62, 64, that are use to attach top and bottom rings 66, 68 to arm 48. Each of the other arms 46, 50 are similarly constructed and attached to the rings 66, 68. The three radial support arms support the top and bottom rings. Each ring is preferably composed of several sections bolted together to encircle the mast. A ring maybe bolted together on the ground or in the air. Each hollow section is preferably a square tube. The two rings allow the mounting of Individual antennas at any required azimuth.

It can now be appreciated that a combined water tank and wireless communications tower has been presented. By strategically locating the tower, the reserve capacity of water needed by fire departments or water systems can be provided while providing an antenna tower for about the cost of a conventional antenna tower alone. Wireless providers estimate that the need for towers of the height described herein will grow from a current level of about 25,000 sites to well over 100,000 in the United States by the end of the year 2000.

The water tank can be fitted with the usual minimum kinds of accessories. A 24-inch or larger diameter shell manhole can be provided as well as interior and exterior tank ladders. The tower is vented horizontally through the transition section which is also fitted with a roof hatch above the interior ladder and an external ladder up to the antenna mast ladder. There is no ladder in the transition section but one or more rigging lugs are provided. The antenna mast, and all metal accessories, are hot-dipped galvanized to eliminate the need for initial and future painting and thereby eliminate consideration of repaint problems when locating the antenna cables. The water tank will be painted inside and outside according to local codes The antenna support ring assemblies consist of two circular rings of square steel tubing supported off the mast by three radial support arms spaced equidistant horizontally around the mast. The two rings have about an 8-foot inside diameter and are connected to the support arms by the vertical plate assemblies. The antennas are attached to pipe stanchions that are clamped to the tubular rings. The rings have been designed to support the weight of two 250-pound technicians spaced at any point on the rings in addition to the weight of the rings themselves and the antennas.

Each complete ring can be fabricated in three sections. Bolting flanges at the ends of each section allow for field bolting of the rings to the vertical members on the support arms. The assembly can be done on the ground before the mast is erected or can be done in the air. Each section weighs about 40 pounds. The radial support arms are fabricated from 4-inch round pipe and have a vertical plate assembly welded to the outside ends. The inside ends of the support arms are welded to an 8-inch square bolting flange. The support arm assembly weighs about 65 pounds. The support arms can be bolted to the mast on the ground before erection or can be bolted in the air. The inner nuts at each arm position can be tack welded to the inside of the mast before galvanizing so that it would not be necessary to have an installer both inside and outside of the mast during the attachment.

The support arms also function as ports for the jumper cables running from the main cables to the individual antennas. The jumpers will connect to the main cables inside the mast and then run outside within the pipe arm for routing along the ring tubes to the associated antenna. The 4-inch diameter of the arms will easily accommodate six or seven one inch diameter jumpers.

A set of combination lifting and rigging lugs are provided at the top of the mast. The lifting lug holes can be used to lift the mast into position after the water tower has been erected up through the bolting flange at the top of the transition section.

Natural venting of the mast interior can occur through the exit ports in the radial support arms. If it is decided to seal these ports with foam after the jumper cables are deployed, then two 6-inch diameter horizontal screened vents can be located within six inches of the mast roof, While the invention has been described with particular reference to the preferred embodiments, it will be understood by those skilled in the art that various changes may be made and equivalents may be substituted for elements of the preferred embodiments without departing from invention. For example, taller towers can be constructed if stronger or thicker steel is used. It is accordingly intended that the claims shall cover all such modifications and applications as do not depart from the true spirit and scope of the invention.

What is claimed is:

1. An integrated water and antenna tower, comprising:

a cylindrical water tank having sidewall, a top end portion, a bottom end portion and a first diameter;

a hollow, cylindrical antenna mast having a second diameter, a sidewall, a top end portion, a bottom end portion, an opening adjacent said bottom end portion and at least one reinforced opening, said first diameter being larger than said second diameter;

a hollow support arm fastened to said antenna mast about said reinforced opening forming a passageway from an interior of said antenna mast to an interior of said support arm;

a hollow, conical transitional member having a bottom portion fastened to said top end portion of said water tank and having a top portion bolted to said bottom portion of said antenna mast; and a cable port formed about said opening of said antenna mast.

2. An integrated tower, as set forth in claim 1, including communications cables extending along an exterior of said sidewall of said tank through said cable port and along an interior sidewall of said mast.

3. An integrated tower, as set forth in claim 1, wherein said transitional member has a height, top diameter and bottom diameter, said height being equal to the difference between said top and bottom diameters.

4. An integrated tower, as set forth in claim 1, wherein said water tank has at least twice the height of said antenna mast.

5. An integrated tower, as set forth in claim 1, including an antenna support fastened to said antenna mast above said cable port.

6. An integrated tower, as set forth in claim 1, including an access door between said antenna mast and said transitional member for internal passage between said antenna mast said transitional member.

7. An integrated tower, as set forth in claim 1, wherein said antenna mast has a roof on said top end portion and including an roof hatch formed in said roof for ingress and egress to an interior of said antenna mast.

8. An integrated water and antenna tower, comprising:

a cylindrical water tank having sidewall, a top end portion, a bottom end portion and a first diameter;

a hollow, cylindrical antenna mast having a second diameter, a sidewall, a top end portion, a bottom end portion, a first opening adjacent said bottom end portion and a second opening above said first opening, said first diameter being larger than said second diameter;

a hollow, conical transitional member having a bottom portion fastened to said top end portion of said water tank and having a top portion bolted to said bottom portion of said antenna mast;

a cable port formed about said first opening of said antenna mast; and a hollow support arm fastened to said antenna mast about said second opening forming a passageway from an interior of said antenna mast to an interior of said support arm.

9. An integrated tower, as set forth in claim 8, including an access door between said antenna mast and said transitional member for internal passage between said antenna mast said transitional member.

* * * * *